United States Patent [19]

Sankaran

[11] 4,214,467

[45] Jul. 29, 1980

[54] METAL COIL HANDLING SYSTEM

[75] Inventor: Subbiah Sankaran, Walnut Creek, Calif.

[73] Assignee: Kaiser Aluminum & Chemical Corporation, Oakland, Calif.

[21] Appl. No.: 17,880

[22] Filed: Mar. 5, 1979

[51] Int. Cl.[2] ..... B21C 47/16

[52] U.S. Cl. ..... 72/183; 242/78.8; 226/92

[58] Field of Search ..... 72/183, 129, 250; 242/78.6, 78.8, 78.7, 79, 81; 226/92

[56] References Cited

U.S. PATENT DOCUMENTS

| | | | |
|---|---|---|---|
| 2,385,533 | 10/1945 | Yoder | 72/165 X |
| 4,047,416 | 9/1977 | Johnson | 72/183 |
| 4,117,989 | 10/1978 | Petros | 242/79 |

*Primary Examiner*—Milton S. Mehr

*Attorney, Agent, or Firm*—Paul E. Calrow; John S. Rhoades

[57] ABSTRACT

This invention relates to a metal coil handling system that allows the user to fully automate operations involving the conventional unwrapping of the leading end of a coil of metal from the remainder of the metal coil and subsequently threading the said leading end of the coil through rolling mill entry rolls. The invention includes equipment for disengaging and peeling this leading end of the coil away from the remainder of the coil and for holding the peeled length of metal coil strip taut throughout the mill feeding operations. The instant handling system eliminates or minimizes frictional scratches in the body of the coil normally caused by unwrapping and rewrapping of the leading end of metal during mill feeding operations. The arrangement of the aforesaid devices is also such that normal passage and movement of the main body of the coil to the mill is not obstructed and easy access to the same is always available for troubleshooting and maintenance purposes with minimum disturbance of metal coil being processed on the mill.

41 Claims, 6 Drawing Figures

METAL COIL HANDLING SYSTEM

BACKGROUND OF THE INVENTION

Various attempts have been made in the past to automate the handling of metal coils, as well as the peeling away of the initial turns or wraps of the coils from the main bodies of the coils and subsequently threading the same through rolling mill entry rolls as illustrated, for example, by the coil handling equipment of U.S. Pat. Nos. 3,150,706; 3,187,530; 3,746,229; 3,010,672; 2,965,329; 2,280,564; 2,266,067; 2,762,418; and 4,091,649. The instant "no slack" coil handling system constitutes an improvement over the prior coil handling systems as represented by the above patents by substantially completely eliminating the necessity of any manual coil handling from the time a metal coil is initially handled by the system until the peeled leading end is subsequently threaded through the entry rolls of a metal gauge reducing rolling mill, such as a cold rolling mill. In other words, while in the past there were usually some requirements for manual handling of a coil which could interrupt or disrupt various operations in a mill facility, the instant coil handling system is designed to avoid such disruptions and minimize or eliminate manual handling of a coil. Furthermore, the quality deterioration within the body of the coil due to friction or "take up"scratches normally caused by loosening and tightening of the leading end in conventional coil handling arrangements and which can lead to metal rejection is eliminated despite the wide range of coil diameters that the mill may process. Attempts in the past to achieve similar "no slack" peeling and holding of the leading end of a metal coil have usually resulted in the utilization of complex and expensive equipment that is generally located in line with the mill and not readily accessible for troubleshooting and maintenance during mill operation. The coil handling system of the invention avoids the complex equipment of the past without at the same time, however, endangering metal quality, consistency or efficiency in mill operation regardless of the different sizes of coils handled by the equipment for a given mill.

SUMMARY OF THE INVENTION

This invention is concerned with a fully automated system for handling heavy gauge metal coil at the entry end of a metal finishing mill, such as a cold mill, used in the nonferrous and ferrous metal industries. Prior to being rolled on the cold rolling mill, the coil may or may not have been annealed after being initially rolled on a hot rolling mill. The metal may also have been continuously cast into strip form and coiled to the extent current technology permits the production of heavy gauge strip in coil form.

More particularly, the instant development is concerned with an automated system for unwrapping a coil of metal and then threading the unwrapped and leading end of said coil through entry rolls of a cold rolling mill or the like. The system comprises a coil support means; coil strip handling elements located adjacent the entry end of a rolling mill; and coil strip peeler means insertable between the leading end of the metal coil and the remainder of the coil for disengaging and freeing the leading end of the coil from the remainder of the coil. The system further includes a combination mandrel and strip clamp or strip clamping means for piercing the coil and then subsequently engaging the leading end of the coil after the leading end has been freed from the remainder of the coil. Means are also provided after the coil has been rotated on the mandrel for feeding the leading end of the coil gripped by the strip clamping means to the entry rolls of a cold rolling mill.

BRIEF DESCRIPTION OF THE DRAWING

FIGS. 4, 5 and 6 comprise schematic diagrams of one suitable electromechanical control system for controlling the operation and automating the equipment shown in FIGS. 1 through 3, while using conventional relays or programmable controllers and the like.

DETAILED DESCRIPTION

Figure 1:
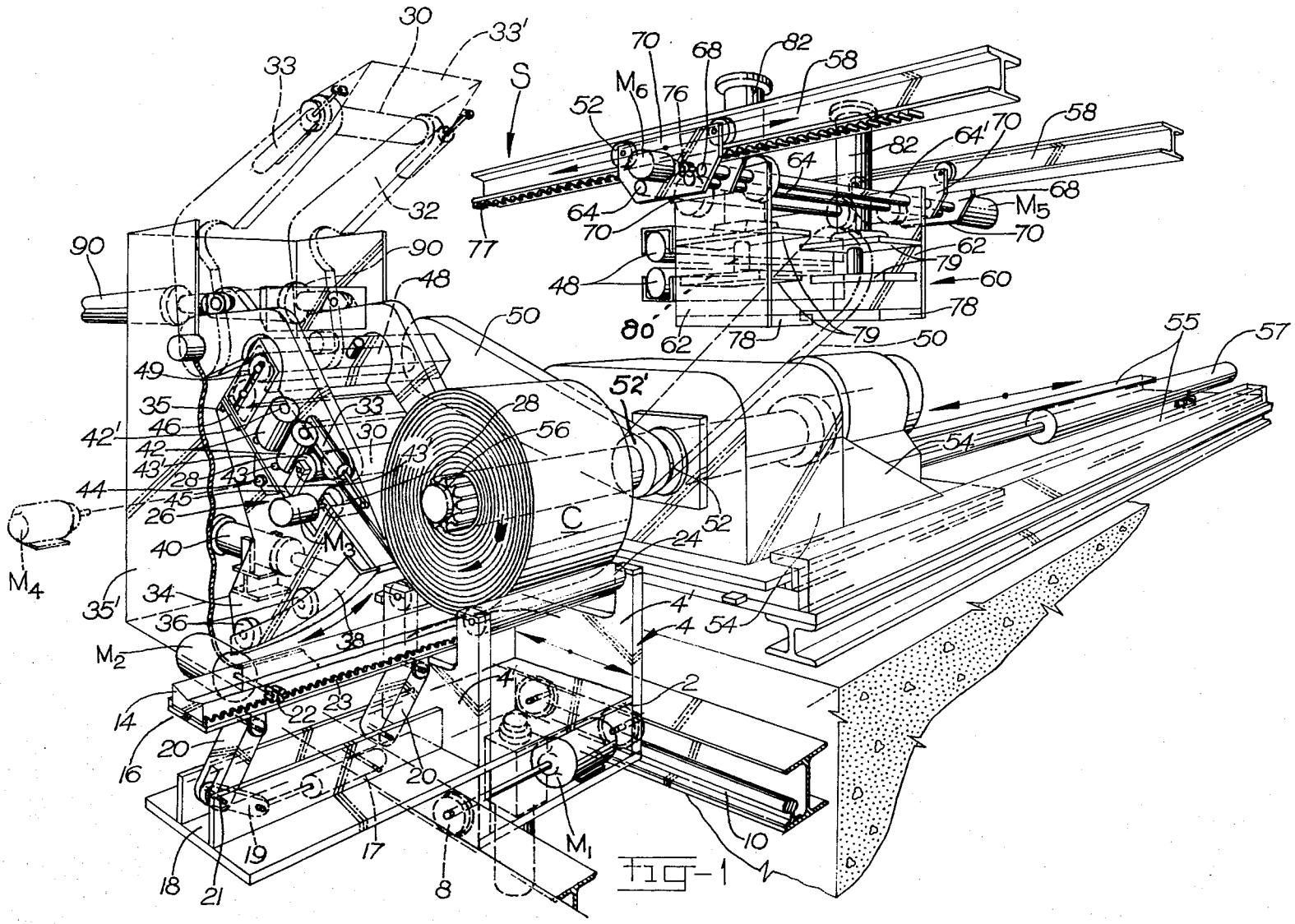
FIG. 1 is an overall perspective view with parts removed and other parts broken away of the various items of equipment used in the system of the invention for unwrapping and threading the leading end of a coil through the entry rolls of a rolling mill.
Figure 2:
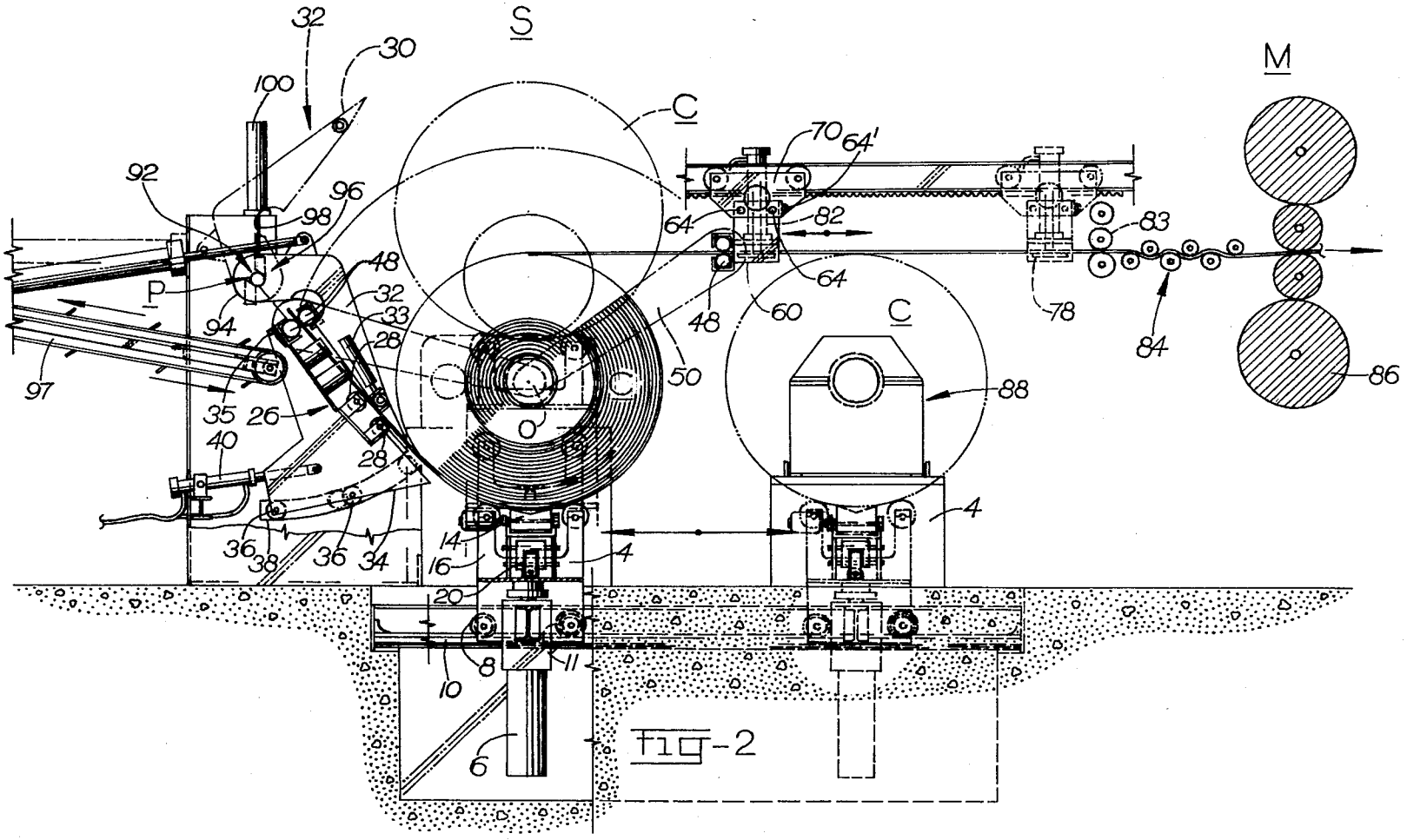
FIG. 2 is a side elevational view of the equipment shown in FIG. 1 with parts removed and other parts added.
Figure 3:
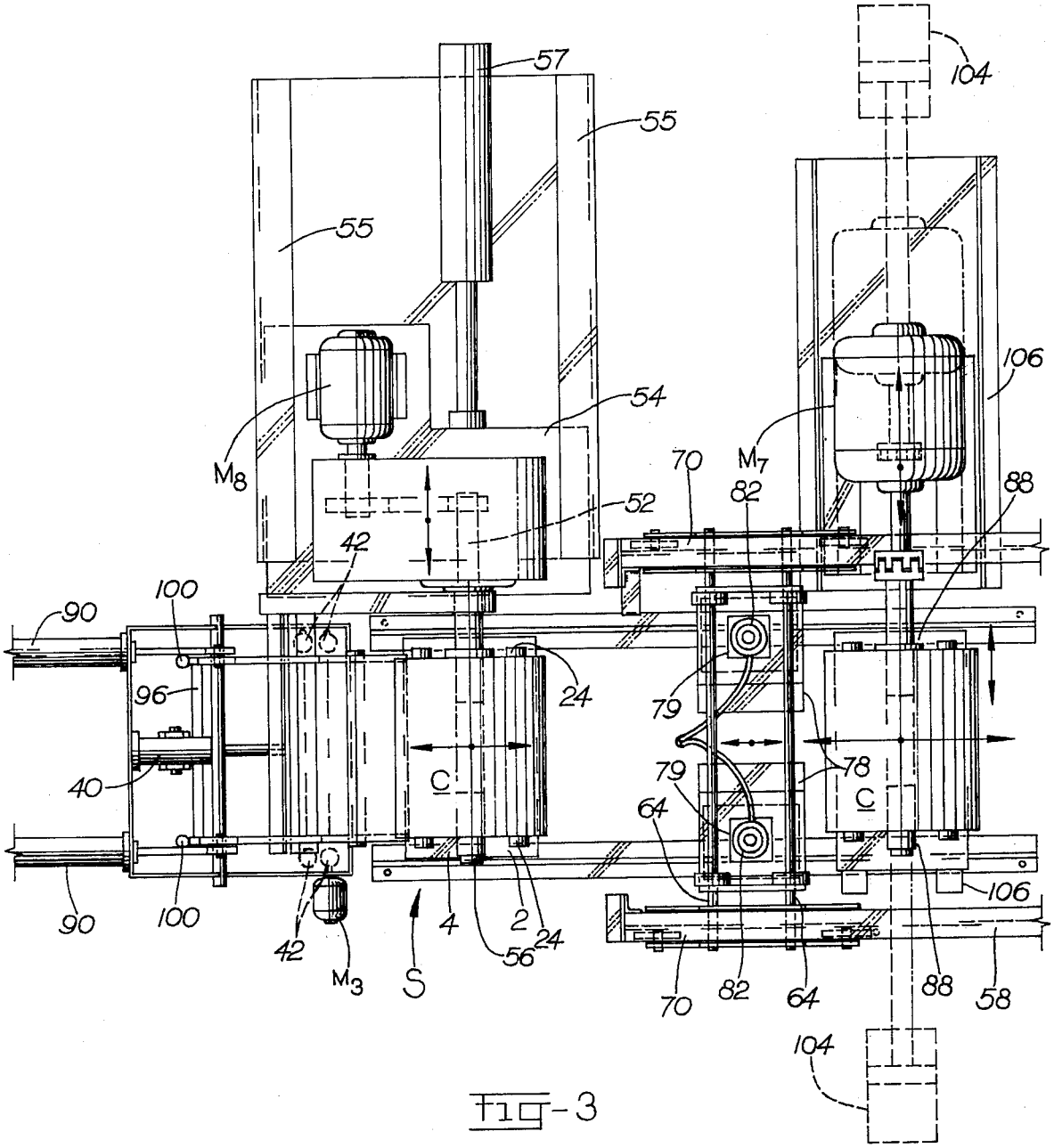
FIG. 3 is a top plan view of the equipment shown in FIGS. 1 and 2 with parts removed and parts added.

With further reference to the drawings, and in particular FIGS. 1 through 3, the coil handling system of the instant invention is generally comprised of a conventional track mounted coil car 2. Coil car 2 is provided with a support elevator or platform 4 movably mounted on the car and provided with slotted sides 4'. Support elevator 4 is connected to and adapted to be raised and lowered by the piston and cylinder assembly 6 carried by car 2. Car 2 is also fitted with the usual wheels 8 by means of which the car can traverse the tracks 10. One or both sets of car wheels 8 is adapted to be driven by the electric motor $M_1$ or other propulsion means along the rails 10 in a manner well known in the art. The rails 10 for car 2 lead from the coil preparing station S to a position adjacent the entry end of the rolling mill M.

The coil preparing station S is further equipped with a combination coil lift and walking beam 14. The walking beam or a similar loading device well known in the art is used for loading the coil C onto the car 2. Since the invention pertains to the handling of a metal coil after the coil has been properly loaded on the car by suitable means, the selection of a walking beam, conveyor or other device is dictated by material handling and storage requirements of the specific installation.

In the system as illustrated, walking beam 14 fits in a channel-shaped guide and support 16. Guide 16 is further supported by the jacking lever arms 20 pivotally mounted on a base plate 18 and pivotally connected to the underside of beam support 16. A crank arm 19 operated by piston and cylinder assembly 17 is connected to the shaft 21 for one of the lever arms and acts to pivot shaft 21 to cause selective rotation of arms 20 and the raising and lowering of beam 14. Walking beam 14 is further equipped with a pinion gear 22 driven by a motor $M_2$ also carried by beam 14 and gear 22 is adapted to contact the teeth of rack 23 affixed to guide 16. This allows walking beam 14 in its elevated position to be moved backwards and forwards along guide 16 and selectively inserted in the openings or slots between the coil contacting rollers 24 affixed to the support elevator sides 4' along with a coil C supported on the beam. When the beam 14 is lowered, it serves to place the coil C on the coil car rollers 24.

Walking beam 14 is also advantageously located adjacent a flattening roll assembly 26. Roll assembly 26 is comprised of a pair of lower coil flattening rolls 28 which are adapted to mate with an upper flattening roll 30 on a peeler arm assembly 32 provided with a moveable wedge shaped peeler arm extension 33' to be described more fully hereinafter. One or more of the rolls 28 can be driven by an electric motor $M_3$. The bottom flattening rolls are mounted on the moveable support or carriage 34. Flattener roll carriage 34 is provided with wheels 36 that fit within the arcuate tracks or guides 38. Carriage 34 is connected by a pivot pin 35 to the housing 35' in such a fashion that the wheels 36 will roll smoothly along guides 38. Guides 38 have their center or axis of curvature at the shear cut point P shown in FIG. 2 so that a line drawn tangential to the outer periphery of a coil on rollers 24 of a coil car 2 will contact the bottom flattening rolls 28 and terminate at one end at the shear cut point P.

Carriage 34 is suitably pivotally connected to a piston and cylinder assembly 40 whereby upon appropriate actuation of assembly 40 and extension of the piston rod for the assembly piston, flattener roll carriage 34 will be moved in an arc upwardly and against a coil C carried by coil car 2 in a manner to be described. Alternately, retraction of the piston within the cylinder of assembly 40 will cause a withdrawal or the downward arcuate movement of the carriage 34 along with the flattener rolls 28 away from the coil C to be wrapped.

Also mounted on carriage 40 and associated with flattener roll assembly 26 are metal strip side guide rolls 42. Rolls 42 are laterally adjustable and can be mounted on a plate section that constitutes a continuation of the upper part of the flattener carriage 34. The spindles 42' for side guide rolls 42 are mounted in elongated slots 43 so that they can be moved sideways and adjusted with respect to the width of strip unwrapped from a given coil. Opposing rolls 42 are interconnected and adjustably controlled symmetrically about the centerline of the strip as follows. The rolls are mounted on spindles 42' that are fixed to brackets 43' whereby the spindles protrude through slots 43 while the brackets are mounted on oppositely threaded sections of a powered screw rod 44 driven by a suitable and appropriately mounted reversible motor $M_4$.

The top of apron for carriage 34 is provided with a seat portion 46 that is adapted to receive clamping rolls 48 that are attached cantilever fashion to one extremity of a pivoting arm 50. Rolls 48 are interconnected at least at one end by a suitable pneumatically or hydraulically operated toggle mechanism 49 or the like that operates to open and close the rolls. The other end of the pivoting arm 50 is affixed by means of an appropriate clutch mechanism (not shown) to the rotatable shaft 52 mounted in a slidable housing 54 located adjacent the unwrapping or coil preparing station S. Shaft extension 52' for shaft 52 comprises a cantilever mounted collapsible reel or mandrel 56 of a type well known in the art. Housing 54, along with arm 50, shaft 52 and mandrel 56 are adapted to be moved backwards and forwards along tracks 55 by the selective operation of piston and cylinder assembly 57. The collapsible mandrel 56 ultimately driven by shaft 52 and motor $M_8$ is adapted to fit within a central opening O of the coil and to engage and rotate the coil C at a selected time in a manner to be more fully described. With reference to FIGS. 2 and 3, it will be observed that associated with the peeler arm assembly 32, the positioning of which is controlled by the synchronized piston and cylinder assemblies 90 pivotally connected to the assembly 30, is a conventional scrap shear 92 comprised of a lower fixed blade 94 and a piston actuated elongated upper blade 96 connected at its opposing ends to the piston rods 98 operated by pistons in the twin cylinders 100. A scrap conveyor 97 of conventional design is located under the shear blades to remove the lengths of cut and trimmed metal from the front end of the peeled coil C to a suitable scrap tub or container.

Located above and in line with coil car tracks 10 is a pair of overhead tracks 58. Mounted for movement along these tracks is a coil strip clamping carriage 60 equipped with opposed clamping bracket elements 62 suspended from opposing ends of the support rods 64. An additional shaft 64' is provided with opposed screw threads at the opposite ends thereof which are adapted to fit within threaded openings 68 in the wheeled dollies 70 suspended from the rails 58. A reversible motor $M_5$ connected to one end of shaft 64' is used to controllably rotate shaft 64' and effect the movement of brackets 62 toward and away from each other so as to adjust the bracket elements relative to each other in accordance with the width of the coil C being processed. A further reversible motor $M_6$ mounted on one of the dollies 70 drives a pinion gear 76 that engages the toothed rack 77 suspended from one of the tracks 58 for moving the carriage 60 backwards and forwards along tracks 58.

Brackets 62 carry, in addition to a pair of bottom clamping shelves 78, a pair of piston and cylinder operated and cooperating clamping plates 79. Plates 79 are depending carried by the piston rods 80 suspended from cylinders 82 and affixed to dollies 70. Clamping plates 79 are adapted to engage the side edges of the coil strip adjacent the leading end of the coil so as to selectively force and hold the leading end of the coil against the bottom shelves 78 upon the proper actuation of the pistons in the cylinders 82.

As indicated particularly in FIGS. 1 and 2, the dollies 70 are adapted to move along the tracks 58 upon the selected operation of reversible motor $M_6$ and rotation of pinion gear 76 after the leading end of the coil has been engaged between the clamping elements 79 and the lower shelf sections 78 for the purpose of advancing the leading end of the coil to and then threading the coil through the initial pinch rolls 83 of the mill bridle roll assembly 84 located adjacent the main mill rolls 86. Pinch rolls 83 are adjustable as will be described hereinafter and at the time that the leading end of the strip is inserted in the pinch rolls, the coil car 2 will have been advantageously moved and brought into registry with the unwinding dual stub mandrel assemblies 88 of a standard design well known in the art that can be adjusted toward and away from each other and one of which is connected to and can be driven by a motor $M_7$.

The general operation and automatic unwinding and threading of a coil C will now be described with particular reference to FIGS. 4–6 which schematically illustrate a typical electromechanical circuit arrangement which can be used for automatically controlling the overall operation of the equipment of the invention by use of conventional relays or by a programmable controller mechanism.

Prior to the actuation and automatic sequencing of the electrical system components, it is to be understood that the particular coil C that is to be processed is first positioned on walking beam 14, the coil having been placed upon the beam by an overhead crane (not shown) in a manner well known. The desired number of scrap shear cuts that are to be made on the leading end of the coil C which is stripped from the coil C proper has also been programmed into a standard pulse sensor-counter schematically shown in FIG. 4 and of a type that is sold by Electronic Counter & Controls, Inc., of Mundelein, Illinois, under Model No. MU200.

The bottom flattener roll assembly carriage 34 at this time is retracted away from the coil car 2 while the top flattener roll and peeler arm assembly 32 are disposed in an out-of-the-way or up position and the scrap shear 92 is in an open position. The coil car 2 is in the position shown in FIGS. 1 and 2 but with the coil car elevator 4 therefor in the down position, while the expandable coil receiving mandrel 56 and the pivoting clamping roll arm 50 are in retracted positions or off to the right from their positions as shown in FIG. 1. The mandrel 56 is collapsed and the clamping rolls 48 are open. The mill unwind stub mandrel assemblies 88 can be open or they can be utilized for rolling of the previous coil so that the coil tail preparation on the new coil can, if desired, be performed independently of the mill rolling cycle.

Figure 4:
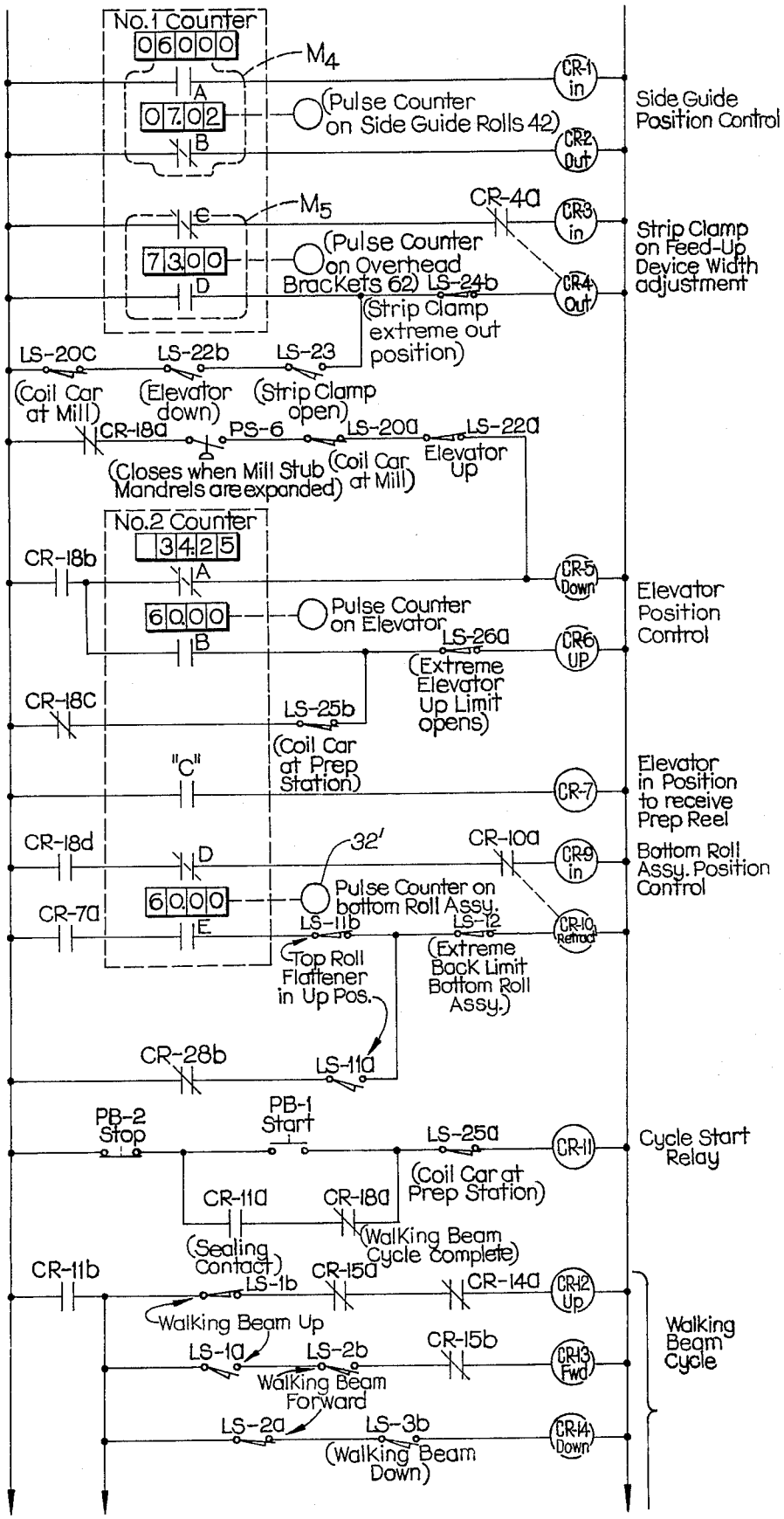
Figure 5:
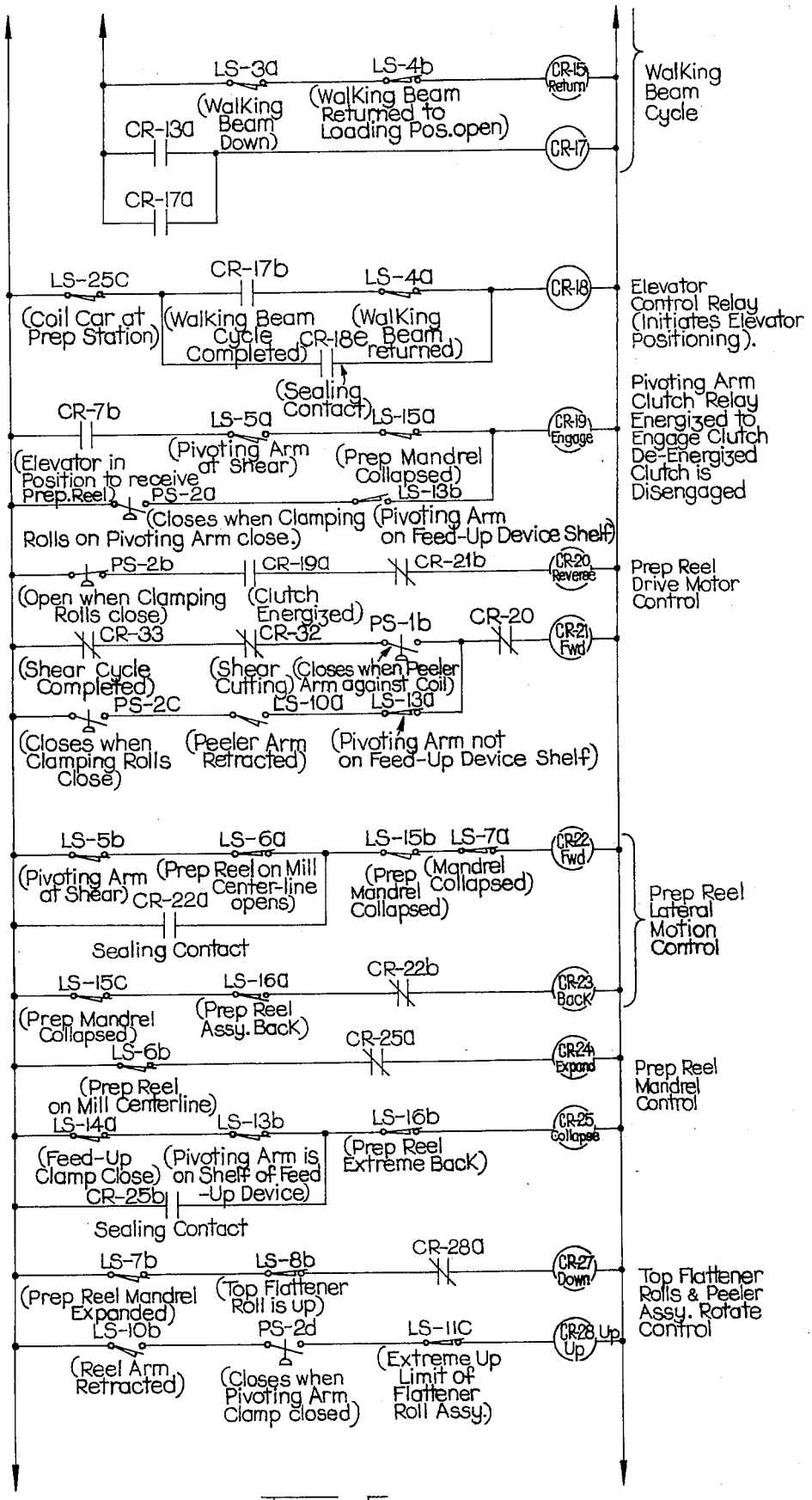

With the aforementioned pieces of equipment in the above-described positions, it will be noted that the sensors of the photoelectric noncontacting type or of the mechanical contact type, such as those sold by the aforesaid Electronic Counters & Controls, Inc., under Model No. PU840, near the walking beam 14 first operate to measure the width of the coil C being processed and then feed the measured width signals into the No. 1 pulse counter schematically shown in FIG. 4 to be 60.00 inches. The contacts of the pulse counter then energize either one of the relays CR-1 or CR-2 that control the reversible motor $M_4$ for the motor-driven screw rod 44 for the side guide rolls 42, whereby the distance between the guide rolls on either side of carriage 34 is automatically set to match the width of the coil C being processed. In this case, for example, relay CR-2 is energized and operates to drive the side guide rolls 42 outwardly from their position as indicated of 07.02 inches until they match the preset width of 60.00 inches at which time contacts "A" and "B" of pulse sensor-counter No. 1 are then opened and sideways movement of side guide rolls 42 stopped.

The width, e.g., 60 inches, preset on Counter No. 1 also causes the overhead strip clamp brackets 62 of clamping carriage 60 to move inwardly. It is shown with a setting wide open at 73.00 inches and since contact "C" is closed, relay CR-3 becomes energized. When relay CR-3 is energized, it picks up contacts in the circuit for the clamping assembly adjustment motor $M_5$ which operates oppositely threaded shaft 64' for clamping brackets 62 thereby closing the strip clamp assembly brackets 62 to 60.00 inches. When this occurs, both contacts "C" and "D" of sensor-counter No. 1 will be placed in an open condition and the clamp width for bracket 62 will be properly set.

Additional conventional coil sensor-counters similar to these described above near the walking beam 14 operate to successively measure the outside diameter of the coil being processed and then to feed the coil diameter measurement signals properly into pulse sensor-counter No. 2 also shown schematically in FIG. 4 at, for example, 34.25 inches so as to preset counter No. 2. This sensor-counter No. 2 is also of a type similar to those noted above. The operator next depresses start button PB-1 shown in FIG. 4 in the circuit for relay CR-11. Depression of start button PB-1 initiates the walking beam cycle during which the beam 14 will carry or lift the measured coil C into position onto the coil car elevator rolls 24. Beam 14 then returns to its normal retracted unloaded position. Also as noted above, just prior to depression of button PB-1, the pulse sensor-counter No. 2 is set by the coil diameter sensors in this case to 34.25 inches.

At this point in the operation of the system, coil car elevator 4 is down in its lowest position, having been driven down after previously depositing a coil between the stub mandrels 88 at the mill. In this event, the number indicated for the elevator would be larger than the largest diameter coil. As the coil car elevator 4 raises, the pulse sensor-counter No. 2 will reduce the number on the sensor-counter until it equals the set coil diameter. Thus, the position of coil car elevator 4 as shown is at a position where the eye or opening O of the coil C 60.00 inches in diameter should line up with the mandrel 56. However, the coil diameter is actually only 34.25, therefore, contact "B" of the counter No. 2 will be operated by sensor-counter No. 2 to close permitting coil car elevator 4 to be driven upward when contact CR-18*b* of the sensor-counter and in the circuits for relays CR-5 and CR-6 closes later on in the operational cycle to be described.

The walking beam cycle operates generally as follows. As switch PB-1 is depressed, and since the coil car 2 is at the prep station, limit switch L2-25*a* in relay circuit CR-11 contactable by car 2 will be closed, causing relay CR-11 to become energized and effect closing of switch contacts CR-11*a*. Closing of contacts CR-11*a* then operates to seal the circuit for relay CR-11, thereby keeping relay CR-11 fully energized. Switch contacts CR-11*b* for relay CR-12 also close upon energization of relay CR-11 and since switch LS-1*b* is also closed, at this time, relay CR-12 will be energized. As relay CR-12 is energized, it will operate to actuate the solenoid valve (not shown) for the piston and cylinder assembly 17 controlling crank arm 19 so as to move beam 14 up along with a coil C until beam 14 opens switch LS-1*b* in the circuit for relay CR-12 stopping the upward travel of the beam 14. At the same time, switch LS-1*a* contactable by beam 14 will be closed by the action of beam 14 energizing relay CR-13. Relay CR-13 then operates to close contacts (not shown) in the walking beam drive motor $M_2$ circuit. Motor $M_2$ drives a pinion gear 22 in contact with a rack guide 16 so that the walking beam 14 along with coil C can move to the right as viewed in FIG. 1 and with the outer coil periphery somewhat above and out of contact with coil car rolls 24. As the walking beam 14 moves forward and carries the coil to a position over the elevator car 2, it trips and opens limit switch LS-2*b* in the circuit for relay CR-13 so as to deenergize relay CR-13 and stop the forward motion of the walking beam, while at the same time closing limit switch LS-2*a* for relay CR-14, which then operates to energize relay CR-14. Energization of relay CR-14 causes a shifting of the spool of the aforesaid solenoid-operated valve (not shown) for the piston and cylinder assembly 17 controlling the beam crank arm 19, thereby pivoting crank arm 19 to lower beam 14. As beam 14 is lowered, it allows the coil C to come to rest on the elevator rolls 24 of the coil car 2. Beam 14 continues to recede and move downward until it trips and closes limit switch LS-3*a* for relay CR-15, thereby energizing relay CR-15, while at the same time opening switch LS-3*b* deenergizing relay CR-14.

Switch contacts CR-15*a* and CR-15*b* controlled by relay CR-15 now open in the walking beam drive motor circuit $M_2$ allowing the reversal of the motor $M_2$ in a well-known manner and reversing driving pinion gear 22 for the walking beam, thereby causing the unloaded beam 14 to move to the left as viewed in FIG. 1 to a retracted position. Upon returning to its coil loading position, beam 14 will trip and open switch LS-4*b* deenergizing relay CR-15 stopping the drive motor $M_2$ while at the same time closing limit switch LS-4*a* in the circuit for relay CR-18. The closing of limit switch LS-4*a* will bring about energization of relay CR-18 because switch contacts CR-17*b* for relay CR-17 were previously picked up and sealed through the closing of switch contacts CR-17*a* earlier in the walking beam cycle. Relay switch contacts CR-18*e* will keep relay CR-18 energized through the sealing effected by contact CR-18*e* until the coil car 2 moves off limit switch LS-25*c* later in the operation.

In addition to switch CR-18*e*, relay CR-18 controls the contacts of switches CR-18*a*, CR-18*b*, CR-18*c* and CR-18*d* in the No. 2 sensor-counter system used to control the positioning of the coil elevator 4 relative to the collapsible preparation reel or mandrel 56.

With the circuit in the aforesaid operating condition, car elevator 4 can now be properly moved up or down to adjust the coil relative to the collapsible mandrel 56. As relay CR-18 became energized, it operates to close the contacts of switches CR-18*b*, CR-18*d* and CR-18*e* while opening contacts of switches CR-18*a* and CR-18*c*. With switch CR-18*b* closed, relay CR-6 of FIG. 4 becomes energized. As relay CR-6 becomes energized and since contacts "C" of sensor-counter No. 2 are also closed at this time, it operates the solenoid valving mechanism for raising the coil car elevator 4 attached to the piston rod in the piston and cylinder assembly 6. As the solenoid valving mechanism for the piston cylinder assembly 6 is moved to the proper position, the coil car elevator 4 will raise the coil C and finally stop when its calculated position matches the setting of the pulse counter No. 2 with respect to the coil's outside diameter.

It is to be noted at this point that the contact "C" of pulse counter No. 2 controlling relay CR-7 of FIG. 4 will, due to the operation of the sensor-counter No. 2 now close while the contacts "A" and "B" will open and relay CR-6 will drop out. Closing of switch contacts "C" in pulse counter and sensor No. 2 will energize relay CR-7. Energization of relay CR-7 will close switch contacts CR-7*a* in the circuit for relay CR-10, along with switch contacts CR-7*b* in the circuit for the relay CR-19 of FIG. 5.

This overall electrical sequencing now operates to locate the eye or opening O of the coil C on center with the axis of preparation reel mandrel 56 at the proper elevation. With further reference to FIG. 4, it will be noted, that when switch contacts CR-18*b* in the counter No. 2 are closed, relays CR-5 and CR-6 which control the solenoid valving for the piston and cylinder assembly will be properly actuated in accordance with the programming of counter No. 2 to operate and jockey the coil elevator 4 into the proper position so as to obtain axial registry of coil mandrel 56 and coil center opening 0. The aforementioned closing of switch CR-18*d* will in the meantime have operated to energize relay CR-9 which controls the piston and cylinder assembly 40 for moving the flattening roll carriage 34 in an arcuate path by way of pivot pin 35 and into the proper tangential position with respect to the coil C. The forward movement of carriage 34 is controlled by a standard pulse counter (not shown) connected to the bottom carriage rolls 36 which operates in accordance with coil diameter signals regulated or produced in accordance with the size of the coil.

Since limit switch LS-15*a* in relay circuit CR-19 is closed as the mandrel 56 is collapsed and this being the condition of the mandrel at this time when switch contacts CR-7*b* also in relay CR-19 circuit are closed by operation of pulse counter No. 2, the relay CR-19 will become energized. Energization of relay CR-19 causes a standard clutch mechanism (not shown) to operate and effect engagement of motor-driven shaft 52 with clamp arm 50. As relay CR-19 becomes energized, it also closes switch contacts CR-19*a* in the circuit for relay CR-20. As the contacts of switch CR-19*a* close, they energize relay CR-20 because at this time, the clamping rolls 48 affixed to arm 50 are open and there is no opening pressure on pressure switch PS-2*b* for relay CR-20 so the contacts of this switch PS-2*b* are closed.

Various other contacts (not shown) in the circuit of relay CR-20 close in the circuit for the reel motor $M_8$ that drives shaft 52 upon energization of relay CR-20 causing in a well-known standard fashion activation of the clutch between arm 50 and shaft 52 so that as motor $M_8$ rotates in the proper direction, it will pivot arm 50 to the left as viewed in FIGS. 1–3.

As the pivoting clamp assembly arm 50 reaches its forward position or its position remote from the mill M, it trips and opens limit switch LS-5*a* in the circuit for relay CR-19, while closing limit switch LS-5*b* in the circuit for relay CR-22, thereby energizing relay CR-22 while opening the circuit for relay CR-19. As relay CR-19 drops out, it deenergizes the clutch mechanism and reel motor $M_8$ for shaft 52 and arm 50 so that the pivoting action of arm 50 ceases and clamping rolls 48 will now be located along axial lines which, when extended or projected are located as indicated in FIGS. 1 and 2 intermediate the strip end shear 92 and side roll guides 42. It is to be also understood that the clutching mechanism (not shown) and used to engage the mandrel 56 with shaft 52 will also be disengaged at this time.

At this point in time, the coil is supported on the coil car 2. The mandrel carriage 54 is located off to the side of the coil and the coil car tracks 10. With the mandrel 56 still in the collapsed condition, as switch LS-5*b* in the circuit for relay CR-22 closes and relay CR-22 becomes energized, a closing of switch contacts CR-22*a* for relay CR-22 will take place and a sealing-locking contact for the relay CR-22 effected. At the same time, switch contacts CR-22*b* in the circuit for relay CR-23 and also controlled by relay CR-22 will be opened. With relay CR-22 energized and relay CR-23 deenergized, the valving for controlling the piston and cylinder assembly 57 connected to carriage 54 will operate to move carriage 54 along tracks 55 and mandrel 56, shaft 52, arm 50 and rolls 48 in an axial direction relative to the coil C to the position shown in FIG. 1 to effect a fitting or threading of the collapsed mandrel within the eye O of the coil C. As the mandrel 56 moves forward along with the attached pivoting clamp arm 50 and is threaded in the opening or eye O of the coil C the aforesaid equipment components will also line up with the mill center line. At the end of this axial travel as noted, limit switches LS-6*a* in the circuit for relay CR-22 and LS-6*b* in the circuit for relay CR-24 will be tripped by one of the equipment elements, e.g., housing 54, such that switch LS-6*a* will open while switch LS-6*b* will close. The closing of switch LS-6*b* energizes relay CR-24 causing the collapsed mandrel 56 to expand while the opening of switch LS-6*a* causes the deenergization of relay CR-22 and a stoppage in the forward travel or movement of housing 54. At this time, the previously collapsed mandrel 56 will have pierced the eye O of coil C and the pivoting lamp arm rolls 48 will also have slid into position along appropriate guides (not shown) on the bottom roll assembly carriage 34.

As mandrel expanding relay CR-24 is energized, it operates a standard mandrel expanding reversible motor (not shown) in the manner conventional in the art to expand mandrel 56 as relay CR-25 controlling the collapse of mandrel 56 remains deenergized. Expansion of mandrel 56 effects an opening of switches LS-15*a* in the circuit for relay CR-19 LS-15*b* in relay CR-22 circuit and a closing of switch LS-15*c* in the circuit for relay CR-23. As reel mandrel 56 expands, it will also effect a tripping and opening of switch LS-7*a* in relay CR-22 circuit and a tripping and closing of switch LS-7*b* in the line for relay CR-27. As switches LS-7*a* and LS-15*b* are opened, relay CR-22 will drop out regardless of the otherwise sealing contact of switch contacts CR-22*a* and the mandrel as it expands will then operate to support the coil by itself even though the coil rail car elevator rolls 24 may stay in some slight pressure contact with the coil C.

As relay CR-27 is energized upon the closing of limit switch LS-7*b*, this relay will selectively operate the solenoid-operated valving system for the twin piston and cylinder assemblies 90 that are connected to a peeler arm assembly 32 and control the movements of the same, whereby the peeler arm assembly 32 carrying top flattening roll 30 will be moved in an arc downward so that roll 30 can nest with the bottom flattener rolls 28.

As roll 30 moves into its nesting position, it will actuate a limit switch LS-8*a* mounted on bottom flattener roll frame 34 closing this switch which is located in the circuit for relay CR-29 while at the same time opening limit switch LS-8*b* in the circuit for relay CR-27. As limit switch LS-8*b* is opened, it will effect a deenergization of the relay CR-27 and a cessation in operation of the solenoid-operated valving mechanism for moving the peeler arm down. In the meantime, the closing of limit switch LS-8*a* in the circuit for relay CR-29 will in turn operate to energize relay CR-29 controlling the valving for the piston and cylinder assemblies 33 that move the peeler arm extension 33' into the coil so as to pry the coil tail or coil end from the coil body per se.

As the wedge-shaped peeler arm extension 33' moves forward into contact with the coil, it also works to actuate and open pressure switch PS-1 in the circuit for relay CR-29, when the desired contact force is applied. As the contacts of switch PS-1*a* open, relay CR-29 becomes deenergized as contacts of switch PS-1*b* also controlled by extension 33' are simultaneously closed in the circuit for relay CR-21. As relay CR-29 drops out, it will deactivate the valves for cylinder assemblies 33 used to extend the peeler arm and the peeler arm will stop its forward coil end prying movement. It is to be understood, of course, that the coil C will have been initially placed on coil car 2 in such a fashion that the strip end edge or coil-free end will be located at the bottom of the coil and in line to freely receive peeler wedge extension 33' operated by cylinder assemblies 33.

Energization of relay CR-21 by the closing of contact PS-1*b* now effects rotation of drive motor $M_8$ for reel drive shaft 52 in a forward direction or clockwise as viewed in FIG. 1 but without rotation of arm 50 because the clutch mechanism for shaft 52 and arm 50 is inactivated at this time. At the same time, the motor $M_3$ will rotate flattener rolls 28 because relay CR-31 is also energized due to the closing of switch LS-8*c* which operated when the flattener rolls nested with the bottom roll assembly, as well as the closing of contact CR-21*a* operated by the now energized relay CR-21. By virtue of the leading end of the coil C being forced away from the remainder of the coil C due to the operation of the peeler arm blade 33', this coil end will be pushed upward between the lower and upper flattener rolls 28 and 30, past the side guide rolls 42 and through the open clamping rolls 48 on the pivotal clamp arm 50 and then through the open scrap shear knives 94 and 96 as a result of the preparation reel drive motor $M_8$ operating and forcing the coil C now supported by mandrel 56 to rotate as the mandrel 56 is rotated.

Figure 6:
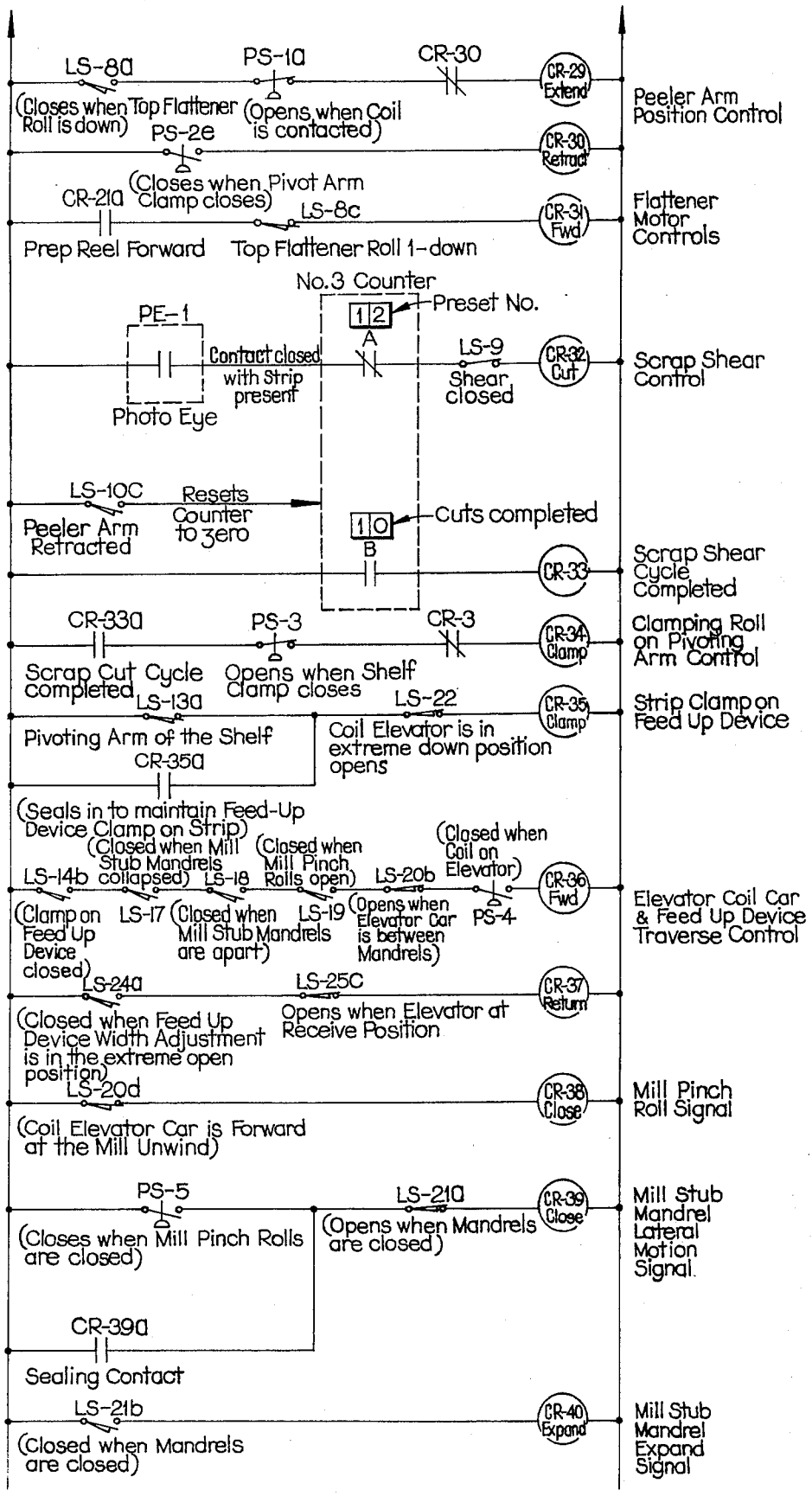

As the end of the coil strip passes through the shear sections 94 and 96, it will continue to advance until it passes a photoelectric eye or cell PE-1 in the circuit for scrap cut sensor-counter device No. 3 shown in FIG. 6 and similar in structure and function to the first two such devices. Sensor-counter No. 3 has also been preset and operates in a well-known fashion to control the strip feed and activation of shear 92 by selectively actuating the valving (not shown) for piston and cylinder assembly 100 that operates the top knife or shear section 96. The pieces of scrap will then fall onto the continuously moving scrap conveyor 97 and as the top shear section 96 in cutting the metal strip reaches its lower shearing position, it will trip limit switch LS-9 in the circuit for relay CR-32 to deactivate relay CR-32 and cause the valving for piston and cylinder assemblies 100 to then return the top knife 96 to its upper or open position.

The uncoiled strip will continue to feed upwardly and past the shear sections 94 and 96 stopping and starting the shear action until the number of prescribed cuts as automatically set out in the pulse counter and sensor No. 3 has been completed. When this occurs and the final cut is made per the setting of counter and sensor No. 3, relay CR-34 which controls the solenoid-operated valve for the clamping rolls 48 of the clamping arm 50 will become energized because the final shear action will operate to energize sensor relay CR-33 which then closes switch CR-33*a* in the circuit for relay CR-34. Relay CR-34 controls the valving for the toggle clamping assembly 49 connected to clamping rolls 48. Activation of assembly 49 closes the clamping rolls 48 on the pivoting clamping roll arm 50 about the strip end.

The closure of pinch rolls 48 effects the closure of pressure switch PS-2*a* in the line for relay CR-19, the opening of switch PS-2*b* in the circuit for relay CR-20, the closing of switch PS-2*c* in the line for relay CR-21, the closing of switch PS-2*d* in the circuit for relay CR-28 and the closing of switch PS-2*e* in the circuit for relay CR-30. Closing of switch PS-2*e* results in a retraction of the peeler arm extension wedge 33' as the piston and cylinder assemblies 33 are reactivated but in an opposite direction from that previously moved towards during activation of relay CR-29 which dropped out as switch PS-1*a* opened when peeler arm contacted the coil C as noted above to retract the wedge 33'.

When relay CR-28 becomes energized, it opens contact CR-28*a* in line for relay CR-27. The energization of relay CR-28 and deenergization of relay CR-27 will then allow the valving for the piston and cylinder assemblies 90 to activate these assemblies and cause the top peeler arm assembly 32 now to rotate upwards and out of the way, along with the retraction of the peeler arm extension 33'. As the peeler arm assembly 32, along with top flattener roll 33, retracts or moves away from the bottom flattener rolls 28, it effects a tripping and opening of limit switch LS-10*a* in the circuit for relay CR-21, as well as an opening of limit switch LS-10*b* in the circuit for relay CR-28 deenergizing relay CR-28 as well. As the top flattener roll assembly 32 rotates upwardly out of the way, it also acts to close limit switch LS-11*a* and to open limit switch 11*b* in the circuit for relay CR-10 and to reclose limit switch LS-11*c* in the circuit for relay CR-28. The closing of contacts CR-28*b* in circuit for relay CR-10 upon deenergization of relay CR-28 brings about an energization of relay CR-10 and a reversal of the solenoid valving for the piston and cylinder assembly 40 that operates the bottom roll assembly carriage 34. When relay CR-10 is energized, it also opens the contacts of switch CR-10*a* in relay CR-9 circuit and thereby deactivates relay CR-9. This means then that the bottom roll assembly carriage 34, along with rolls 36, will move away from the coil C and provide full clearance for the clamping roll arm 50 now to pivot upwardly and toward the strip clamping carriage assembly 60. This is effected as follows.

Pivoting clamping roll arm 50 becomes clutched to the preparation reel mandrel 56 when the toggle mechanism 49 operates to close strip clamping rolls 48 because closure of these rolls selectively actuates the appropriately delayed operating pressure switches PS-2*a*, PS-2*b* and PS-2*c* as follows. Switch PS-2*a* in relay CR-19 is first closed, switch PS-2*b* in relay CR-20 circuit is next opened and finally switch PS-2*c* in relay circuit CR-21 is allowed to close. Closure of contacts for pressure switch PS-2*a* results in energizing the reel mandrel clutch relay CR-19 while opening of the contacts of pressure switch PS-2*b* prevents reverse operation of the mandrel drive motor $M_8$. Closure of contacts of pressure switch PS-2*c* produces an actuation of relay CR-21 that controls the motor contacts for reel motor $M_8$ whereby this motor will now be operated to rotate arm 50 clockwise to the right as viewed in FIGS. 1 and 2.

As the clamping pressure on pressure switch PS-2*c* closes in the circuit for the drive motor forward relay CR-21 so as to carry the pivoting arm clamp with the strip to a fixed position adjacent the strip feed-up device or clamping carriage 60 clamping rolls 48 act to deposit the leading end of the strip of coil C onto the lower shelf segments 78 of the strip clamping carriage 60 car.

It is to be noted that the coil with its leading end clamped will rotate in unison so as to maintain coil integrity without a tightening or loosening of the wraps thereof because of the disengagement of the clutch for reel 56 and shaft 52. It is also to be observed that the pivoting motion of the pivoting arm clamp 50 and rotation of the mandrel 56 stops at the same exact position for all coil sizes, thus ensuring friction scratch-free operation.

This extreme position of the coil strip end will now bring about a closing of the limit switch mechanism that can be effected by arm 50, thereby causing closing of the switch LS-13*b* in the circuit for relay CR-25 and switch LS-13*a* in relay CR-35 circuit. The closing of contact LS-13*a* brings about an energization of relay CR-35 for the valves controlling the pistons in cylinders 82 from which piston rods 80 project that are attached to the clamps 79 on the top carriage, thereby effecting closing of these clamps 79 against the strip end and pinning both edges of the strip end against the spaced bottom plates 78 while also closing contacts CR-35*a* to seal the closure of relay CR-35.

The aforesaid closing of the clamping plates on the coil strip end and the resultant sandwiching of the strip between the plates produces a pinching of the strip along its edges, while at the same time effecting an opening of pressure switch PS-3 contacted by a plate 79, thereby breaking the circuit to relay CR-34. When switch PS-3 opens, relay CR-34 controlling the solenoid valve for the clamp roll toggle mechanism 49 is deenergized and the strip end of the coil released from the clamping roll on the pivoting arm 50. As the clamping rolls 48 and the pivoting arm open, they effect a tripping and closing of switch LS-14*a* in the circuit for relay CR-25 and the closing of switch LS-14*a* brings about an energization of relay CR-25 since switches LS-13*b* and LS-16*b* in relay circuit CR-25 are also closed at this time. The coil preparation reel mandrel 56 can now collapse as relay CR-25 is energized and its controlled switch CR-25*b* in the circuit for relay CR-24 is opened and relay CR-24 deenergized. As mandrel 56 collapses, it operates to trip and close limit switches LS-15*a*, LS-15*b* and LS-15*c* in relay circuits CR-19, CR-22 and CR-23, respectively.

Closing of switch LS-15*c* causes activation of relay CR-23 that controls and shifts the valving for piston and cylinder assembly 57 controlling the lateral movement or shifting of mandrel 56, etc. Proper shifting of the valving now causes the collapsed mandrel to be withdrawn from coil C as the mandrel along with clamping roll arm 50 and housing 54 are moved back away from the mill centerline in a lateral direction. This leaves the coil supported solely by the coil car elevator rolls 24 and the leading end of the coil engaged by the carriage clamp elements 78 and 79 of carriage 60. As mandrel 56 and pivoting clamp arm 50 move backwards to their extreme out-of-the-way position, the housing 54 for the same will trip and open switch LS-16*a* in the circuit for relay CR-23. The opening of switch LS-16*a* will cause the deactivation of relay CR-23 and a cessation in the backward lateral movement of housing 54 and elements carried thereby, e.g., mandrel 56 and arm 50, etc. At this point in the cycle, the new coil has been prepared and held ready for the prior rolling operation to cease so as to effectively load the mill unwind stub mandrels as soon as they are free.

In the event that the unwind stub mandrels 88 have completed processing of a previous coil through the mill and with the stub mandrels 88 being in a collapsed condition, switch LS-17 in relay circuit CR-36 can be closed by a suitable actuating mechanism at the mill allowing the unwind stub mandrels to open and move apart. Switch LS-18 actuated by the stub mandrels and also in relay circuit CR-36 can now close and since the entry mill pinch rolls 83 controlling switch LS-19 are now open, switch LS-19 in the circuit for relay CR-36 is also closed because switches PS-4 and LS-14*b* are also closed at this time. This means then that the coil car 2 with the coil C on the elevator rolls 24 thereof can now move forward to the unwind stub mandrel location due to energization of relay CR-36 which controls the motor contacts for coil car motor $M_1$ and overhead strip clamp carriage dolly motor $M_6$. Thus, the strip clamp feed-up device or carriage 60 will travel an equal distance in a synchronized fashion along with the coil car 2 so that proper tension will be maintained on the leading edges of the strip as the overhead strip clamp carriage rolls 52 traverse the upper rails 58 and coil car rolls 8 traverse lower rails 10. When the coil car 2 moves forward to its final position between the stub mandrels 88, limit switch LS-20*a* in the circuit for relay CR-5 and switch LS-20*c* in the circuit for relay CR-4 will be closed along with limit switch LS-20*d* in the circuit for relay CR-38 while limit switch LS-20*b* in relay circuit CR-36 is opened. The closing of switch LS-20*d* in relay CR-38 circuit will close the rotating mill bridle pinch rolls 83 by energizing relay CR-38 which controls the solenoid valving for the usual bridle pinch rolls piston and cylinder assembly or other actuator (not shown) to bring the pinch rolls together and permit a threading of the strip end of the coil through the bridle rolls 84 since the coil C can freely rotate on coil car rollers 24 which now support the coil C.

Moreover, since the axes of unwind stub mandrels 88 are all disposed at the same level or elevation as that of mandrel 56, the coil will pass between the collapsed unwind stub mandrels 88 at the proper elevation for later engagement by the stub mandrels 88. At the same time, the protruding end of the coil strip beyond the strip clamp feed-up device carriage 60 is moved to the entry end of mill pinch rolls which have now closed due to the actuation of relay CR-38 as noted. As pinch rolls 83 are brought together, they actuate pressure switch PS-5 in the circuit for relay CR-39 when the prescribed roll pinch force has been attained. As pressure switch PS-5 closes, it will operate to energize relay CR-39 since switch LS-21*a* in this relay circuit is also closed at this time because the stub mandrels 88 are still open. Relay CR-39 controls the solenoid valves for the mill stub mandrel trunion gap control piston and cylinder assemblies 104 schematically shown in FIG. 3. These piston and cylinder assemblies 104 are suitably connected to the bases for the stub mandrels and the mandrel bases are supported on base slides or tracks 106 and upon energization will motivate these valves so that assemblies 104 will force the stub mandrels together.

As the unwind stub mandrels 88 close and pierce the coil from opposite sides in a well-known manner, they will come in contact with opposite sides of the coil C on car 2 and operate to trip switches LS-21*a* and LS-21*b* in the circuits for relays CR-39 and CR-40, respectively. Switch LS-21*a* will now open and switch LS-21*b* will close. The opening of switch LS-21*a* in relay circuit CR-39 allows relay CR-39 to drop out and the solenoid valving for piston and cylinder assemblies 104 controlled by relay CR-39 to return to a neutral position and halt further inward movement of the stub mandrels.

In the meantime, of course, stub mandrels 88 will have pierced the open eye O of the coil C sufficiently to hold the coil firmly between them and at the same time expand due to energization of relay CR-40 that controls the expansion mechanisms for mandrels 88 as the stub mandrels close pressure switch LS-21*b* in the circuit for relay CR-40 and also actuate pressure switch PS-6 in the circuit for relay CR-5. As relay CR-5 is energized, it operates the solenoid controls for the coil car piston and cylinder assembly 6 so as to cause downward movement or retraction of coil car elevator 4 away from the coil whereby the coil will now remain supported solely by stub mandrels 88.

Inasmuch as limit switch LS-20*a* in the circuit for relay CR-5 will also have been closed at this time by virtue of being depressed by the coil car 2 having traveled to the mill, as well as PS-6, relay CR-5 can now be energized and the coil car elevator 4 lowered to its extreme low position due to the activation of relay CR-5 that controls the valving for car elevator control piston and cylinder assembly 6.

Lowering of car elevator 4 causes the opening of limit switch LS-22*a* in operating relay circuit CR-5 deenergizing this relay, as well as the opening of switch LS-22*b* in the circuit for relay CR-4. As relay CR-4 drops out, it will allow switch CR-4*a* in the circuit for relay CR-3 to close and effect reenergization of relay CR-3 and a reopening of switch CR-3 in relay circuit CR-35. The clamp assembly adjustment motor $M_5$ controlled by relays CR-3 and CR-4 will now operate to open the clamping brackets 62 on carriage 60 so as to clear and free the coil strip from clamping carriage 60. As brackets 62 move to their extreme open condition, switch LS-22 in the circuit for relay CR-35 which controls the piston and cylinders 82 controlling shelf clamps 79 will already have been opened due to the retraction of the coil car elevator 4 so that relay CR-35 can now be deenergized to effect operation of the piston and cylinder assemblies 82 in a reverse direction and an upward and coil release movement of clamps 79. The release of clamping pressure from top clamp elements 79 and sideways movement of brackets 62 completely releases the strip from carriage 60. The coil C is now finally ready to be freely threaded through the pinch rolls 83 and rolling mill bridle rolls 84.

As the aforesaid strip and coil release from carriage 60 and car 2 were taking place, relays CR-36 and CR-37 controlling the motor contacts for upper clamp carriage rail traverse motor $M_5$ and coil car rail traverse motor $M_1$ were respectively deenergized and energized as switches LS-24*a* and LS-25*c* in the circuit for relay CR-37 closed and switch LS-20*b* in the circuit for relay CR-36 opened. These motors then operate to bring coil car 2 with its elevator 4 retracted to its original coil-receiving position at the preparatory station and effect a tripping of switches LS-25*b* and LS-25*c*. Switch LS-25*b* closes and switch LS-25*c* opens. When switch LS-25*b* closes, it operates to reset the elevator 4 position control in sensor-counter No. 2 and bring it to its proper position so that the coil car elevator 4 can then be raised again to its full up position, whereby it can trip switch LS-26*a* in the circuit for relay CR-6 which then permits the walking beam to commence feeding the next coil to the coil car 2 with its elevator 4 in the desired receiving position. In the meantime, upper carriage 60 will also stop upon opening of switch LS-25*c* in the circuit for relay CR-37 as the coil car elevator 4 is now in its coil-receiving position.

An advantageous embodiment of the invention has been shown and described. It is obvious that various changes and modifications may be made therein without departing from the spirit and scope thereof as defined by the appended claims wherein:

I claim:

1. A system for unwrapping a coil of metal and threading the leading edge of said coil through rolling mill entry rolls or the like comprising a moveable coil support means, coil strip peeler means insertable between the leading edge of the metal coil and the remainder of the coil for disengaging and freeing said leading edge of the coil from the remainder of the coil, selectively operable mandrel and strip clamp means for successively piercing said coil and then engaging the leading edge of the coil after the coil strip peeler means has separated the leading edge of the coil from the remainder of the coil, means for rotating the coil on the coil support means so as to effect a feeding of the leading edge of the coil to said strip clamp means, means for actuating said strip clamp means to grip the leading edge of the coil, means for selectively rotating said strip clamp means while the leading edge of the coil is gripped by said strip clamp means simultaneously with said coil so as to align said leading edge of the coil with additional coil edge handling means after the strip clamp means has engaged and gripped the leading edge of the coil and means for operating and synchronizing the movements of all of said means.

2. The system as set forth in claim 1 including guide means associated with said coil strip peeler means for directing the leading edge of the strip to said strip clamp means.

3. A system as set forth in claim 1 including a shear means for selectively trimming the leading edge of the coil strip prior to selectively rotating the strip clamp means and aligning the leading edge of the coil with the additional coil edge handling means.

4. A system as set forth in claim 1 wherein said mandrel and strip clamp means are supported by a common housing and said system includes a rotatable arm for supporting the strip clamp means at one extremity thereof and in spaced relation to the mandrel.

5. As system as set forth in claim 1 wherein said additional coil edge handling means comprise track mounted moveable coil edge clamping elements.

6. A system as set forth in claim 1 wherein said moveable coil support means includes a track mounted coil car provided with a vertically moveable coil support platform.

7. A system as set forth in claim 1 wherein said strip clamp means includes a pair of clamping rollers.

8. A system as set forth in claim 1 including means for adjusting said coil strip peeler means to accommodate said peeler means to coils of different diameters.

9. A system as set forth in claim 2 wherein said guide means are adjustable to accommodate coils of different widths.

10. A system as set forth in claim 1 including means for adjusting said coil strip peeler means to accommodate said peeler means to coils of different diameter and adjustable guide means for directing the leading edge of the strip to said strip clamp means after disengagement of said coil leading edge from the remainder of the coil.

11. A system as set forth in claim 1 wherein said additional coil edge handling means comprise track mounted and adjustable coil edge clamping elements, said coil edge clamping elements being moveable simultaneously with said coil support means to a position adjacent rolling mill entry rolls.

12. The system of claim 5, wherein said clamping elements are adjustable.

13. A system for unwrapping a coil of metal and threading the leading edge of said coil through rolling mill entry rolls or the like comprising the combination of a moveable coil support means, coil strip peeler means insertable between the leading edge of the metal coil and the remainder of the coil while the coil is positioned on said coil support means for disengaging and freeing said leading edge of the coil from the remainder of the coil, combination mandrel and strip clamp means carried by a common housing for successively piercing the eye of said coil and engaging the leading edge of the coil subsequent to the strip peeler means freeing the leading edge of the coil from the remainder of the coil, means for rotating the coil of metal on the coil support means so as to effect a feeding of the leading edge of the coil to said strip clamp means, means for actuating said strip clamp means to effect a gripping of the leading edge of the coil by said strip clamp means, and means for selectively rotating said mandrel and the strip clamp means so as to align said leading edge of the coil with additional coil edge handling means after the strip clamp means has engaged and gripped the leading edge of the coil and means for operating and synchronizing the movements of all of said means.

14. The system as set forth in claim 13, including guide means associated with said coil strip peeler means for directing the leading edge of the strip to said strip clamp means.

15. A system as set forth in claim 13 including a shear means for selectively trimming the leading edge of the coil strip prior to selectively rotating the strip clamp means and aligning the leading edge of the coil with the additional coil edge handling means.

16. A system as set forth in claim 13 wherein said combination mandrel and strip clamp means includes an arm for supporting the strip clamp means in spaced relation to the mandrel.

17. A system as set forth in claim 13 wherein the additional coil edge handling means comprise moveable and track mounted coil edge clamping elements.

18. A system as set forth in claim 13 wherein said strip clamp means includes a pair of clamping rollers.

19. A system as set forth in claim 13 including means for adjusting said coil strip peeler means to accommodate said peeler means to coils of different diameters.

20. A system as set forth in claim 14 including means for adjusting said guide means to accommodate coils of different widths.

21. A system as set forth in claim 14 including means for adjusting said coil strip peeler means whereby said peeler means can operate on coils of different diameter and means for adjusting said guide means to accommodate coils of different widths.

22. A system as set forth in claim 13 wherein said additional strip coil edge handling elements comprise overhead track mounted and adjustable coil edge clamping elements and said coil support means comprises a track mounted coil car provided with rolls for supporting the coil and means for effecting simultaneous movement of the coil car and coil edge clamping elements along with the portions of the coil respectively carried thereby to positions adjacent the entry end of a rolling mill.

23. A system as set forth in claim 20 wherein certain of said guide means comprise rollers.

24. A system as set forth in claim 13 wherein said strip clamp means comprises a pair of rolls.

25. A system for unwrapping a coil of metal and then threading the leading edge of said coil through rolling mill entry rolls or the like comprising the combination of a moveable coil support means, coil strip peeler means insertable between the leading edge of the metal coil and the remainder of the coil while the coil is positioned on said coil support means for disengaging and freeing said leading edge of the coil from the remainder of the coil, strip flattener rolls, combination mandrel and strip clamp means carried by a common housing for successively piercing the eye of said coil and engaging the leading edge of the coil subsequent to the strip peeler means freeing the leading edge of the coil from the remainder of the coil, means for rotating the coil of metal on the coil support means so as to effect a feeding of the leading edge of the coil past said strip flattener rolls to said strip clamp means, means for actuating said strip clamp means to effect a gripping of the leading edge of the coil by said clamp means, means for selectively rotating said mandrel and the strip clamp means so as to align said leading edge of the coil with additional coil edge handling means after the strip clamp means has engaged and gripped the leading edge of the coil and means for operating and synchronizing the movements of all of said means.

26. The system as set forth in claim 25 including guide means associated with said coil strip peeler means for directing the leading edge of the strip to said strip clamp means.

27. A system as set forth in claim 25 including a shear means for selectively trimming of the leading edge of the coil strip prior to selectively rotating the strip clamp means and aligning the leading edge of the coil with the additional coil edge handling means.

28. A system as set forth in claim 25 wherein said combination mandrel and strip clamp means includes an arm for supporting the strip clamp means in spaced relation to the mandrel.

29. A system as set forth in claim 25 wherein the additional coil edge handling means comprise moveable and track mounted coil edge clamping elements.

30. A system as set forth in claim 25 wherein said strip clamp means includes a pair of clamping rollers.

31. A system as set forth in claim 25 including means for adjusting said coil strip peeler means to accommodate said peeler means to coils of different diameters.

32. A system as set forth in claim 25 including means for adjusting said guide means to accommodate coils of different widths.

33. A system as set forth in claim 25 including means for adjusting said coil strip peeler means whereby said peeler means can operate on coils of different diameter and means for adjusting said guide means to accommodate coils of different widths.

34. A system as set forth in claim 25 wherein said additional strip coil edge handling elements comprise overhead track mounted and adjustable coil edge clamping elements and said coil support means comprises a track mounted coil car provided with rolls for supporting the coil and means for effecting simultaneous movement of the coil car and coil edge clamping elements along with the portions of the coil respectively carried thereby to positions adjacent the entry end of a rolling mill.

35. A system as set forth in claim 25 wherein certain of said strip flattener rolls are driven.

36. A system as set forth in claim 1 wherein said additional coil edge handling means comprise coil edge clamping elements movable toward the rolling mill entry rolls simultaneously with said moveable coil support means.

37. A system as set forth in claim 13 wherein said additional coil edge handling means comprise coil edge clamping elements moveable toward the rolling mill entry rolls simultaneously with said moveable coil support means.

38. A system as set forth in claim 25 wherein said additional coil edge handling means comprise coil edge clamping elements moveable toward the rolling mill entry rolls simultaneously with said moveable coil support means.

39. A system as set forth in claim 36 wherein said coil edge clamping elements are adjustable so as to accommodate coil of different widths.

40. A system as set forth in claim 37 wherein said coil edge clamping elements are adjustable so as to accommodate coil of different widths.

41. A system as set forth in claim 38 wherein said coil edge clamping elements are adjustable so as to accommodate coil of different widths.

* * * * *

UNITED STATES PATENT AND TRADEMARK OFFICE

CERTIFICATE OF CORRECTION

PATENT NO. : 4,214,467

DATED : July 29, 1980

INVENTOR(S) : Subbish Sankaran

It is certified that error appears in the above-identified patent and that said Letters Patent are hereby corrected as shown below:

Column 3, Line 29, "wrapped" should be --unwrapped--

Column 3, Line 46, "apron" should be --apron 45--

Column 6, Line 29, "L2-25a" should be --LS-25a--

Column 15, Line 31, "As" should be --A--

Signed and Sealed this

*Fourteenth* Day of *April 1981*

[SEAL]

*Attest:*

RENE D. TEGTMEYER

*Attesting Officer*

*Acting Commissioner of Patents and Trademarks*